US005304075A

United States Patent [19]

Hoffman

[11] Patent Number: 5,304,075

[45] Date of Patent: Apr. 19, 1994

[54] CABLE CLAMP WITH STRESS DISTRIBUTING GRIP

[75] Inventor: Ernest G. Hoffman, Middlefield, Conn.

[73] Assignee: Hubbell Incorporated, Orange, Conn.

[21] Appl. No.: 62,533

[22] Filed: May 18, 1993

[51] Int. Cl.[5] ..... H01R 13/595

[52] U.S. Cl. ..... 439/472

[58] Field of Search ..... 439/469, 472, 465–467

[56] References Cited

U.S. PATENT DOCUMENTS

| | | | |
|---|---|---|---|
| 2,577,748 | 12/1951 | Gillespie | 285/6.5 |
| 2,911,616 | 11/1959 | Townsend | 439/814 |
| 3,402,382 | 9/1968 | De Tar | 439/469 |
| 3,437,980 | 4/1969 | Smith | 439/469 |
| 3,571,781 | 3/1971 | Gartland, Jr. et al. | 439/465 |
| 3,784,961 | 1/1974 | Gartland, Jr. | 439/465 |
| 3,865,461 | 2/1975 | Ludwig | 439/463 |
| 4,010,999 | 3/1977 | Hoffman | 439/467 |
| 4,080,036 | 3/1978 | Hagel | 439/692 |
| 4,178,056 | 12/1979 | Lee | 439/472 |
| 4,213,667 | 7/1980 | Wittes | 439/469 |
| 5,021,006 | 6/1991 | Fargeaud et al. | 439/469 |
| 5,217,389 | 6/1993 | MacKay et al. | 439/466 |

*Primary Examiner*—Gary F. Paumen

*Attorney, Agent, or Firm*—Jerry M. Presson; Alfred N. Goodman

[57] ABSTRACT

An electrical wiring device having opposing cable clamping mechanisms. The clamping mechanisms grip opposite sides of an electrical cable inserted within a housing. Each clamping mechanism includes at least one annular member which extends into the passageway of a housing and which has a saddle-shaped cable gripping end surface. A plug-shaped member, which also has a saddle-shaped end and is coaxial with the annular member, extends outwardly from within the annular member into the passageway. The annular member and plug of each clamping mechanism apply sufficient compression forces to the cable to resist slippage.

14 Claims, 3 Drawing Sheets

CABLE CLAMP WITH STRESS DISTRIBUTING GRIP

FIELD OF THE INVENTION

This invention relates to an electrical wiring device having a cable or cord clamp with a stress distributing grip. More specifically, this invention relates to a cable clamp having annular members with saddle-shaped end surfaces which grip opposite sides of a cable and distribute clamping forces over a large area of the cable, thereby resisting cable slippage.

BACKGROUND OF THE INVENTION

Typically, electrical connectors and other wiring devices have cable clamps for gripping and coupling an electrical cable thereto. These cable clamps are conventionally designed to have at least one clamping member movable substantially perpendicular to the longitudinal axis of the cable. The clamping member, which may be a screw, a rib, or a series of ribs, extends into the passageway of the connector and engages and thereby couples a cable within the connector.

More than one member may be used. When this is done, the members often oppose one another and thus, engage opposite sides of the cable.

However, when significant longitudinal force is applied to a cable coupled within one of these typical connectors, the cable tends to slip because the clamp is unable to satisfactorily grip and hold the cable within the connector. In other words, the gripping force produced by the members on the cord is insufficient to securely hold the cable within the connector.

Furthermore, conventional cable clamps have a relatively small area that engages the cable. Thus, the gripping force on the cable is concentrated in a small area and the stress on the cable is high. The concentrated stress may cut, deform or otherwise damage the cable. Also, the highly concentrated gripping stress produces high stress at the cable exit point. Thus, when the cable is flexed cable fatigue failure may result.

Examples of some prior electrical connectors with cable clamps are disclosed in the following U.S. Pat. Nos.: 2,577,748 to Gillespie; 2,911,616 to Townsend; 3,402,382 to De Tar; 3,437,980 to Smith; 3,784,961 to Gartland; 3,865,461 to Ludwig; 4,080,036 to Hagel; 4,178,056 to Lee; 4,213,667 to Wittes; and 5,021,006 to Fargeaud et al.

Thus, there exists a need to provide an improved electrical wiring device with cord clamping mechanisms which distribute a uniform force over a wide area on the cable, thereby resisting cord slippage and damage. This invention addresses this need in the art, along with other needs which will become apparent to those skilled in the art once given this disclosure.

SUMMARY OF THE INVENTION

Accordingly, a primary object of the invention is to provide an electrical wiring device for coupling a cable within a housing having opposing clamping mechanisms which distribute sufficient compression forces on the cable to resist or prevent cable slippage.

Another object of the invention is to provide an electrical wiring device for coupling a cable within a housing having opposing clamping mechanisms which distribute the forces applied to the cable over a large area and thereby minimize the shear stress concentrations on the cable jacket and conductors.

Another object of the invention is to provide an electrical wiring device for coupling a cable within a housing having opposing clamping mechanisms which produce lower stresses at the cable exit point, thus reducing cable fatigue failure when the cable is flexed.

A further object of the invention is to provide an electrical wiring device for coupling a cable within a housing having opposing clamping mechanisms which do not cut, unduly deform or otherwise damage the cable.

A further object of the invention is to provide an electrical wiring device for coupling a cable within a housing having opposing clamping mechanisms which can be quickly and easily coupled to a cable.

A further object of the invention is to provide an electrical wiring device for coupling a cable within a housing having opposing clamping mechanisms which is relatively inexpensive to manufacture.

The foregoing objects are basically attained by providing an electrical wiring device, the combination comprising: a housing having first and second ends, and a passageway for receiving an electrical cable thereon; a first clamping member having a first annular gripping surface; a second clamping member having a second annular gripping surface; and means for rigidly coupling the first and second clamping members to the housing with the electrical cable located between and engaged by the first and second annular gripping surfaces to clamp the electrical cable and to secure the electrical cable to the housing.

Other objects, advantages and salient features of the invention will become apparent from the following detailed description, which, taken in conjunction with the annexed drawings, discloses two embodiments of the invention.

BRIEF DESCRIPTION OF THE DRAWINGS

Referring now to the drawings which form part of this original disclosure.

DETAILED DESCRIPTION OF THE INVENTION

Figure 1:
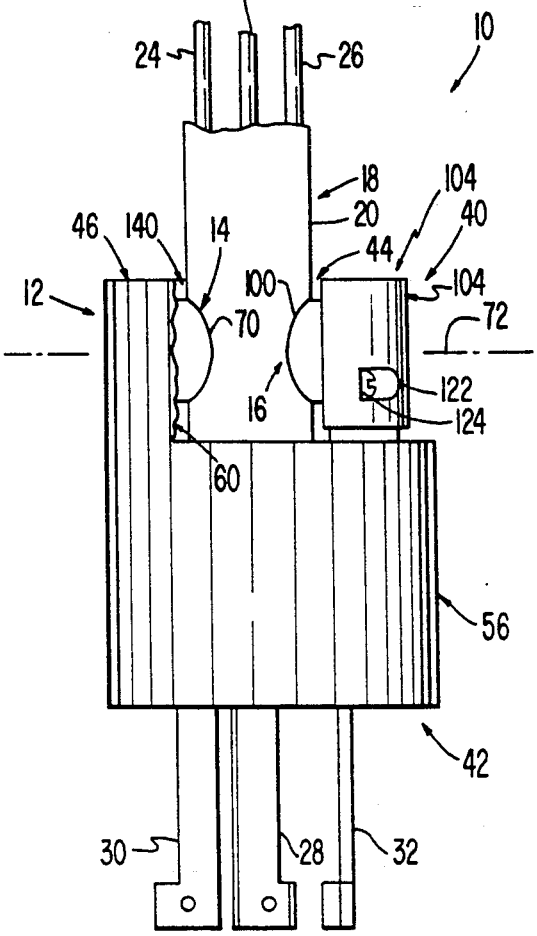
FIG. 1 is a side elevational view of the electric wiring device in accordance with the present invention partially broken away to show the first and second clamping mechanisms in accordance with the present invention.

As seen in FIG. 1, an electrical wiring device 10 in accordance with a first embodiment of the present invention is illustrated, and includes a housing 12 having a first clamping mechanism 14 rigidly coupled thereto. A second clamping mechanism 16 is movably coupled to the housing 12. First and second clamping mechanisms 14 and 16 grip electrical cable or cord 18 and securely couple it within the housing 12. Advantageously, first and second clamping mechanisms 14 and 16 have saddle-shaped surfaces which engage opposite sides of the cable 18.

Figure 2:
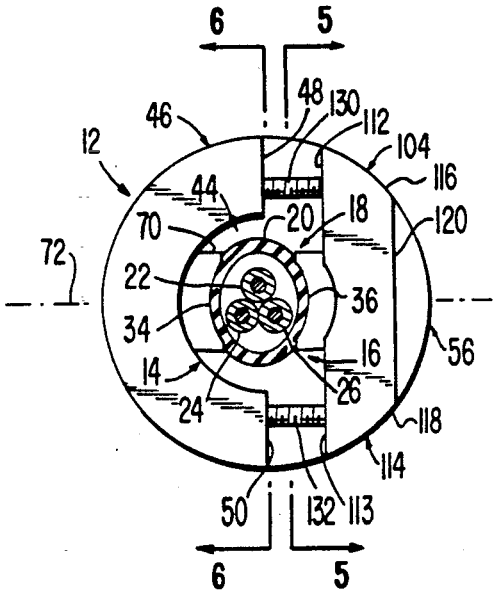
FIG. 2 is a top plan view of the electrical wiring device with the cable in cross-section.

Cable or cord 18, as best seen in FIGS. 1 and 2, has an outer protective jacket 20 formed of insulating rubber or plastic and a plurality of electrical conductors 22, 24 and 26 extending therethrough. Cable 18 may have any number of conductors; however, three conductors are typical. Conductors 22, 24 and 26 are formed of conductive metal and an insulating outer sheath and electrically connect with contacts 28, 30 and 32, respectively, when electrical cable 18 is inserted within housing 12 in a conventional fashion.

Cable 18 also has a first side 34 and a second side 36 which are opposite one another. When cable 18 is inserted and coupled within housing 12, first clamping mechanism 14 engages first side 34 of cable 18, and second clamping mechanism 16 engages second side 36 of cable 18.

Housing or connector 12 may be male or female and is preferably formed of rigid plastic. A male connector is shown. As seen in FIG. 1, housing 12 has a first end 40, a second end 42, a passageway 44 having a longitudinal axis extending parallel to cable 18, first clamping mechanism 14, and contacts 28, 30 and 32. First end 40 receives the cable 18 which extends through passageway 44 until conductors 22 , 24 and 26 electrically connect to contacts 28, 30 and 32 at or adjacent the second end 42. Contacts 28, 30 and 32 extend perpendicularly and outwardly from the second end 42.

Figure 6:
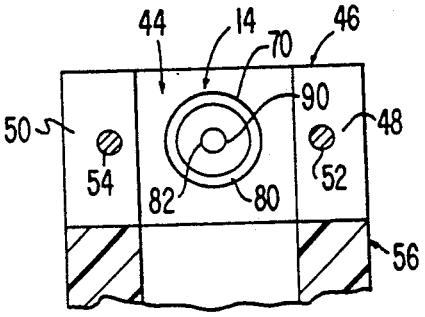
FIG. 6 is a partial cross-sectional view taken along line 6—6 in FIG. 2 with the cable removed.

Semi-cylindrical portion 46 of housing 12 is formed at the first end 40. As seen in FIGS. 2 and 6, semicylindrical portion 46 has first and second coupling surfaces 48 and 50. Surfaces 48 and 50 are coplanar, and passageway 44 extends therebetween. First and second apertures 52 and 54 are spaced apart and extend perpendicularly through first and second coupling surfaces 48 and 50 into semi-cylindrical portion 46.

Substantially cylindrical portion 56 of housing 12 is formed at the second end 42 of housing 12, as seen in FIG. 1. Contacts 28, 30 and 32 extend perpendicularly and outwardly therefrom. Passageway 44 extends through approximately one-half of cylindrical portion 56.

Figure 3:
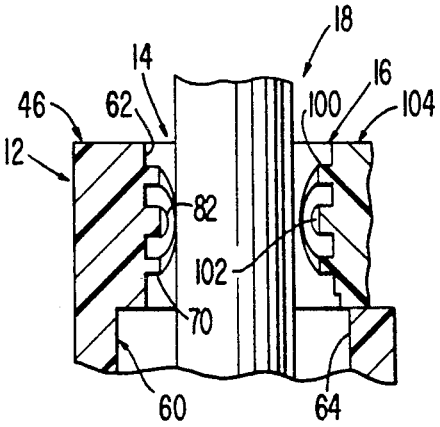
FIG. 3 is a partial longitudinal cross-sectional view of the electrical wiring device showing the clamping mechanisms before engaging the cable.

Passageway 44 forms a wall 60, as seen in FIGS. 1 and 3. Cable 18 is inserted into passageway 44 at the first end 40 of housing and coupled therein.

Passageway 44 has a semi-cylindrical portion 62 at the first end 40, which is located on semi-cylindrical portion 46 of housing 12. Passageway 44 also has a cylindrical portion 64, which extends from semi-cylindrical portion 62 through about half of cylindrical portion 56 of housing 12.

Figure 7:
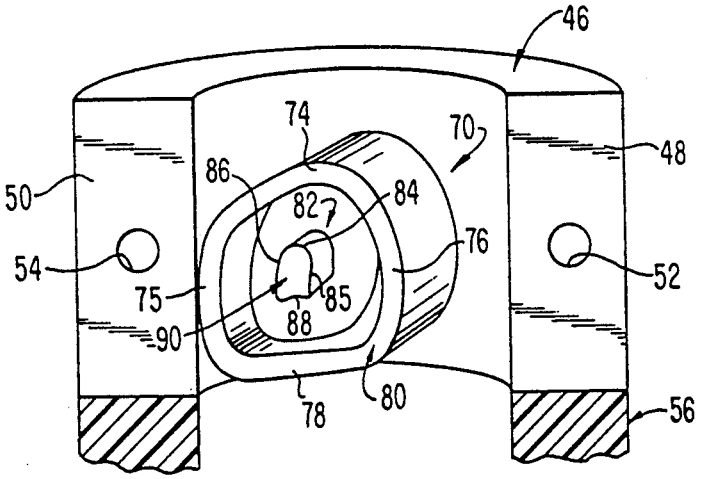
FIG. 7 is a perspective view of the first clamping mechanism shown in FIGS. 1–4 and 6.

As seen in FIGS. 1–4 and 6, first clamping mechanism 14 is unitarily and integrally formed with and rigidly coupled to semi-cylindrical portion 46 of housing 12 from rigid plastic. As best seen in FIG. 7, first clamping mechanism 14 comprises at least one annular member or ring 70 which is generally cylindrical with a circular outer configuration in plan view. First annular member 70 has a central axis which is normal to the longitudinal axis of the cable.

First annular member 70 may be circular as seen in FIGS. 1–4, 6 and 7, or may take any other annular or curved configuration, such as oval, as seen in FIG. 7, or diamond-shaped. First annular ring 70 forms a tooth, has an anticlinal, i.e., saddle-shaped, end surface 80, and extends perpendicularly and outwardly from semi-cylindrical portion 46 of housing 12 into passageway 44 and radially from transverse axis 72, as seen in FIG. 1. Axis 72 extends perpendicularly to passageway 44 and through the center point of first annular member 70. The term "saddle-shaped" is meant to describe a shape formed at the perpendicular intersection of two right cylinders.

First annular member 70 has, at its distal end, top, two side, and bottom portions 74, 75, 76 and 78, respectively, as seen in FIG. 7. The two side portions 75 and 76 extend further outwardly than the top and bottom portions 74 and 78.

Figure 4:
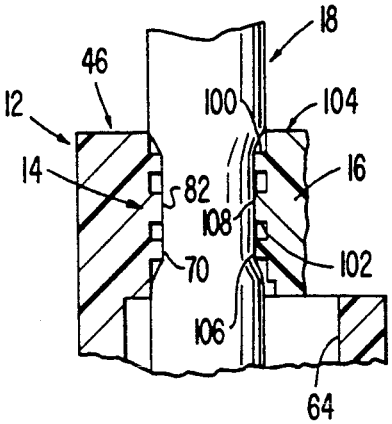
FIG. 4 is a partial longitudinal cross-sectional view of the electrical wiring device showing the clamping mechanisms gripping the cable.

First member 70 uses the annular cable engaging and gripping end surface 80 to engage a portion of the first side 34 of cable 18 when the cable is inserted and coupled within housing 12, as in FIG. 4.

First clamping mechanism 14 also preferably includes a third member or plug-shaped portion 82, as best seen in FIG. 7. Plug portion 82 also has an anticlinal or saddle-shaped end surface and is integrally and unitarily formed with semi-cylindrical portion 46 of housing 12 from rigid plastic.

Figure 9:
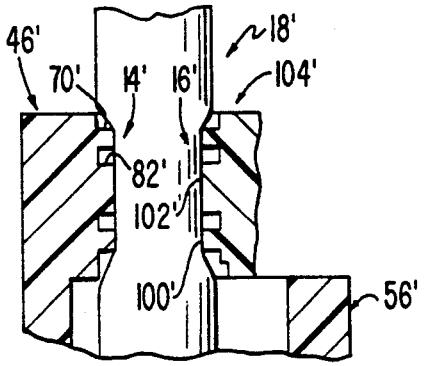
FIG. 9 is an elevational view showing the cable and showing the oval clamping mechanisms configured as in FIG. 8 gripping the cable.

Plug portion 82 is solidly and concentrically formed within first annular member 70 and spaced apart from first member 70. It may be circular in outer configuration, as seen in FIGS. 1–4, 6 and 7, or may take any other annular or curved configuration, such as oval, as seen in FIG. 9, or diamond-shaped, but is preferably shaped like first annular member 70.

Plug portion 82 extends outwardly and perpendicularly from semi-cylindrical portion 46 into passageway 44 and radially from axis 72, but does not extend as far outwardly as first annular member 70. It has top, two side, and bottom portions 84, 85, 86 and 88, respectively. Top and bottom portions 84 and 88 extend as far outwardly as the top and bottom portions of first annular member 70, but side portions 85 and 86 of plug 82 do not extend as far outwardly as the side portions 75 and 76 of first annular member 70.

Plug 82 also has a cable engaging saddle-shaped surface 90 formed by portions 84, 85, 86 and 88. The entire surface area of surface 90 engages a portion of the first side 34 of cable 18.

Second clamping mechanism 16 is identical to first clamping mechanism 14, but is a mirror image thereof, as seen in FIGS. 1–7. Second clamping mechanism 16 has at least a second annular member or ring 100 and preferably also has a fourth member or plug-shaped portion 102, which both extend outwardly and perpendicularly from body 104.

Preferably, second and fourth members 100 and 102 are shaped like first and third members 70 and 82. Thus, they may be circular, as in FIGS. 1–5, oval, as in FIGS. 8 and 9, or any other annular or curved configuration.

Second and fourth members 100 and 102 are coaxial with first and third members 70 and 82 along axis 72 as seen in FIGS. 1 and 2. Second annular member 100 is directly opposite first annular member 70, and fourth member or plug 102 is directly opposite third member or plug 82. However, second and fourth members 100 and 102 extend along axis 72 in the opposite direction as first and third members 70 and 82. In other words, first and second clamping mechanisms 14 and 16 face each other.

Figure 5:
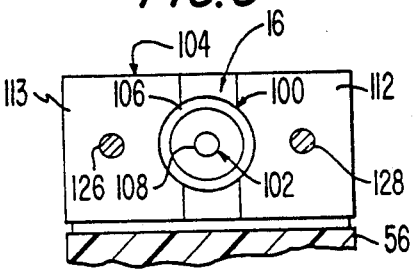
FIG. 5 is a partial cross-sectional view taken along line 5—5 in FIG. 2 with the cable removed.

Second annular member 100 has a cable engaging annular saddle-shaped surface 106, and fourth member or plug 102 has a cable engaging annular, saddle-shaped surface 108, as seen in FIGS. 4 and 5. Cable engaging surfaces 106 and 108 engage the second side 36 of cable 18 when the cable is inserted and coupled within housing 12, as seen in FIG. 4. The cable engaging surfaces 106 and 108 are directly across from and aligned with cable engaging surfaces 80 and 90.

Body or jaw 104 is formed of rigid plastic, and second clamping mechanism 16 extends perpendicularly and outwardly therefrom. Body 104 has coupling surfaces 112 and 113, as seen in FIGS. 2 and 5. Coupling surfaces 112 and 113 are parallel to and face coupling surfaces 48 and 50 of semi-cylindrical portion 46 of housing 12. Body 104 also has an outer surface 114, as seen in FIG. 2. Outer surface 114 has three portions, a first and second arcuate portion 116 and 118, and a third flat portion 120. First and second portions 116 and 118 have a first cut-out (not shown) and a second cut-out 122, which are identical. First cut-out forms a first shelf (not shown), and second cut-out forms a second shelf 124, as seen in FIG. 1.

Third and fourth apertures 126 and 128, respectively, extend perpendicularly through the shelves, outer surface 114 and coupling surface 112. Third and fourth apertures 126 and 128 receive first and second screws 130 and 132, respectively, as seen in FIGS. 2 and 5.

Apertures 126 and 128 are the same distance apart as housing apertures 52 and 54. When body 104 is coupled to housing 12, the first and third apertures 52 and 126 and the second and fourth apertures 54 and 128 align with one another and receive screws 130 and 132. Body 104 is thereby rigidly coupled to housing 12, as seen in FIG. 2, via the screws.

Figure 8:
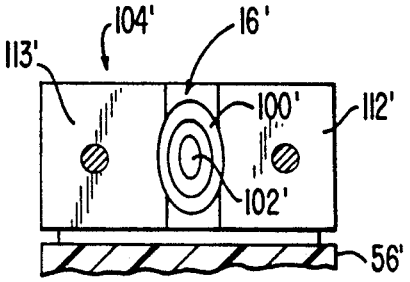
FIG. 8 is an elevational view of a second embodiment of the second clamping mechanism modified to include oval cable gripping members.

Embodiment of FIGS. 8 and 9

The second embodiment of the invention, shown in FIGS. 8 and 9, is substantially the same as the first embodiment shown in FIGS. 1–7 and described above except the annular clamping members are oval in plan view. Like reference numerals are used with the addition of a prime.

Figure 10:
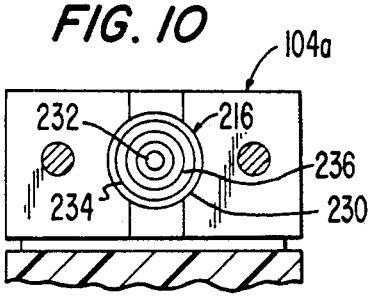
FIG. 10 is an elevational view of a third embodiment of the second clamping mechanism modified to include three gripping members.
Figure 11:
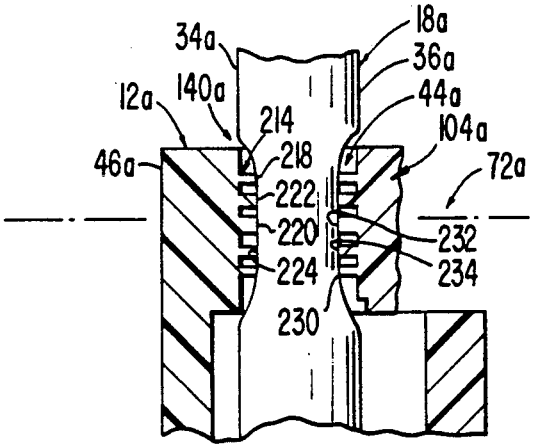
FIG. 11 is an elevational view showing the cable and showing the third embodiment of the clamping mechanisms gripping the cable.

Embodiment of FIGS. 10 and 11

The third embodiment, shown in FIGS. 10 and 11 is substantially similar to the first embodiment previously discussed. Therefore, only the differences will be described in detail. In the third embodiment, first and second clamping mechanisms 214 and 216 each have an additional annular member or ring.

First clamping mechanism has at least a first annular ring 218 and preferably, also has a third member or plug 220, just like the first clamping mechanism of the first embodiment. In addition, first clamping mechanism 214 has a fifth annular member 222.

Fifth annular member 222 has an anticlinal or saddle-shaped end surface and extends perpendicularly and outwardly from the semi-cylindrical portion **46*a* of housing 12*a*. Fifth annular member 222 extends from within first annular member 218 into passageway 44*a*, radially from axis 72*a*, and is spaced apart from first annular member 218 and between first and third members 218 and 220, being concentric with both members. Fifth annular member 222 has a smaller diameter than first annular member 218**, but a larger diameter than third member or plug.

Preferably fifth annular member 222 is the same shape as first and third members 218 and 220, but it may be any shape as previously discussed. Furthermore, it also has a cable engaging end surface 224.

The side portions extend further outwardly than the side portions as described above with regard to the first annular member. Cable engaging surface 224 engages a portion of the first side **34*a* of cable 18*a* when cable 18*a* is inserted and coupled within housing 12*a***.

Similarly, second clamping mechanism 216 has a sixth annular member 234, as seen in FIGS. 10 and 11. Sixth annular member 234 is identical to fifth annular member 222, but is a mirror image thereof. Thus, sixth annular member 234 extends perpendicularly and outwardly from body **104*a* and is coaxial with first clamping mechanism 214, but extends into the opposite side of passageway 44*a*. More specifically, sixth annular member 234 extends from within second annular member 230, radially from axis 72*a*, and is spaced apart from second annular member 230 and between second and fourth members 230 and 232**, being concentric with both members.

Sixth annular member 234 also has a cable engaging surface 236, which engages a portion of the second side **36*a* of cable 18*a* when cable 18*a* is inserted and coupled within housing 12*a*. Thus, sixth annular member 234 extends perpendicularly and outwardly from body 104*a* and radially from axis 72*a* in the opposite direction as fifth annular member 222 and into passageway 44*a* so that cable engaging surface 236 faces cable engaging surface 224**.

Assembly and Operation

The first, second and third embodiments are assembled and operated substantially identically. For simplicity, the assembly and operation will be discussed only with respect to the first embodiment; however, the same applies to the other embodiments.

In assembling electrical wiring device 10, cable 18 is inserted into passageway 44 and conductors 24, 26 and 28 are electrically connected with contacts 28, 30 and 32. Thus, the first side 34 of cable 18 engages the first clamping mechanism's engaging surfaces 80 and 90.

Thereafter, the second clamping mechanism 16 is positioned as in FIGS. 1 and 2, so that the second clamping mechanism's engaging surfaces 106 and 108 engage the second side 36 of cable 18.

Screws 130 and 132, which have been inserted into apertures 126 and 128, are tightened in apertures 52 and 54, thereby bringing the second clamping mechanism 16 toward the housing 12 until cable 18 is securely coupled within passageway 44.

In operation, the first and second clamping mechanisms 14 and 16 exert sufficient gripping or compression forces on the cable 18 to prevent slippage if the cable is axially pulled. The surface area of the engaging surfaces 80, 90, 106 and 108 is sufficiently large to disperse the gripping or compression forces on the cable jacket, thus resulting in lower stresses on the cable. For instance, the distribution of compression forces produces lower stresses at the cable exit point 140, as seen in FIG. 1, thus reducing cable fatigue failure when the cable is subjected to flexing.

The annular and saddle-shaped geometry of the clamping mechanisms 14 and 16 also distributes the shear forces on the table jacket 20, thus also reducing stress concentrations. The reduction of stress concentration on the cable jacket 20 reduces the probability of cutting the jacket, and reduces the stresses acting on the internal current carrying conductors 22, 24 and 26.

While only three embodiments have been chosen to illustrate the invention, it will be understood to those skilled in the art that various changes and modifications can be made herein without departing from the scope of the invention as defined in the appended claims.

What is claimed is:

1. An electrical wiring device, the combination comprising:

a housing having first and second ends, and a passageway for receiving an electrical cable having a longitudinal axis thereon;

a first clamping member having a first annular gripping surface whose central axis is normal to the longitudinal axis of the cable;

a second clamping member having a second annular gripping surface whose central axis is normal to the longitudinal axis of the cable; and means for rigidly coupling said first and second clamping members to said housing with said electrical cable located between and engaged by said first and second annular gripping surfaces to clamp the electrical cable and to secure the electrical cable to said housing.

2. An electrical wiring device according to claim 1, wherein said first and second annular gripping surfaces are each substantially circular in plan view.

3. An electrical wiring device according to claim 1, wherein said first and second annular gripping surfaces are each substantially oval in plan view.

4. An electrical wiring device according to claim 1, wherein each of said first and second annular gripping surfaces has a substantially saddle-shaped contour.

5. An electrical wiring device according to claim 1, wherein each of said first and second clamping members further includes a central gripping surface located inside, respectively, each of said first and second annular gripping surfaces, for engagement with the electrical cable.

6. An electrical wiring device, the combination comprising:

a housing having first and second ends, a passageway, and first clamping means for engaging an electrical cable having a longitudinal axis in said passageway, said passageway being substantially parallel to said longitudinal axis of the cable; and second clamping means, securely coupled to said housing, for engaging the electrical cable in said passageway;

said housing having a transverse axis extending substantially perpendicularly to said passageway, said first clamping means including a first annular member extending from said housing along said transverse axis into said passageway for engaging one side of the cable, said second clamping means including a second annular member being coaxial with and directly opposite from said first member, and extending into the opposite side of said passageway for engaging the opposite side of the cable, said first and second clamping means thereby securely gripping the cable and coupling the cable to said housing.

7. An electrical wiring device as claimed in claim 6, wherein said first clamping means has a third annular member formed concentrically within and spaced apart from said first annular member, and extending outwardly from said housing and into said passageway for engaging one side of the cable;

said second clamping means has a fourth annular member formed concentrically within and spaced apart from said second annular member and extending directly opposite from said third member and into the opposite side of said passageway for engaging the opposite side of the cable.

8. An electrical wiring device as claimed in claim 7, wherein said first and second members extend further outwardly than said third and fourth members.

9. An electrical wiring device as claimed in claim 8, wherein said first and second members have substantially saddle-shaped end surfaces, and said second and third members are plug-shaped.

10. An electrical wiring device as claimed in claim 9, wherein each of said members are circular in outer configuration.

11. An electrical wiring device as claimed in claim 9, wherein each of said members are oval in outer configuration.

12. An electrical wiring device as claimed in claim 9, wherein said first clamping means has a fifth annular member formed concentrically between and spaced apart from said first and third members and extending outwardly from said housing and into said passageway for engaging one side of the cable;

said second clamping means has a sixth annular member formed concentrically between and spaced apart from said second and fourth members and extending directly opposite from said fifth member and into the opposite side of said passageway for engaging the opposite side of the cable.

13. An electrical wiring device as claimed in claim 12, wherein said fifth member extends further outwardly than said third member, and said first member extends further outwardly than said fifth member, and said sixth member extends further outwardly than said fourth member, and said second member extends further outwardly than said sixth member.

14. An electrical wiring device as claimed in claim 13, wherein said fifth and sixth members are cylindrical.

* * * * *